US011168696B2

(12) United States Patent
Myers McCarthy

(10) Patent No.: US 11,168,696 B2
(45) Date of Patent: Nov. 9, 2021

(54) VANE-AXIAL FAN WITH A FAN HOUSING AND SHROUD HAVING AN INTEGRAL ACOUSTIC TREATMENT INCLUDING A MICRO-PERFORATED PANEL AND A PLURALITY OF COMPARTMENTS IN AN ANNULAR BACKSPACE FORMED BY A PLURALITY OF SHROUDS

(71) Applicant: Xcelaero Corporation, San Luis Obispo, CA (US)

(72) Inventor: Stacey Myers McCarthy, Kalamazoo, MI (US)

(73) Assignee: Bascom Hunter Technologies, Inc., Baton Rouge, LA (US)

( * ) Notice: Subject to any disclaimer, the term of this patent is extended or adjusted under 35 U.S.C. 154(b) by 648 days.

(21) Appl. No.: 15/525,488

(22) PCT Filed: Nov. 10, 2015

(86) PCT No.: PCT/US2015/060030

§ 371 (c)(1),
(2) Date: May 9, 2017

(87) PCT Pub. No.: WO2016/077395

PCT Pub. Date: May 19, 2016

(65) Prior Publication Data

US 2017/0335852 A1 Nov. 23, 2017

Related U.S. Application Data

(60) Provisional application No. 62/077,826, filed on Nov. 10, 2014.

(51) Int. Cl.
*F04D 19/00* (2006.01)
*F04D 29/66* (2006.01)

(52) U.S. Cl.
CPC ..... *F04D 19/002* (2013.01); *F04D 29/664* (2013.01); *F04D 29/665* (2013.01); *F05D 2250/51* (2013.01)

(58) Field of Classification Search
CPC .... F04D 19/002; F04D 29/664; F04D 29/665; F05D 2250/51

(Continued)

(56) References Cited

U.S. PATENT DOCUMENTS 2,100,655 A 11/1937 Bourne
3,330,379 A * 7/1967 Cook ..... F24F 7/025 181/224

(Continued)

FOREIGN PATENT DOCUMENTS

CN 2270838 Y 12/1997
GB 984817 3/1965
GB 2485881 A 5/2012

OTHER PUBLICATIONS

X. Hua et al., "Enhancing the Performance of Microperforated Panel Absorbers by Designing Custom Backings," SAE Int. J. Passeng. Cars—Mech. Syst., vol. 6, No. 2, May 2013.

(Continued)

*Primary Examiner* — Patrick Hamo
*Assistant Examiner* — Benjamin Doyle
(74) *Attorney, Agent, or Firm* — Henry C. Query, Jr.

(57) ABSTRACT

A fan comprises a fan housing which includes a shroud having an upstream end that defines an inlet of the fan housing, a motor which is connected to the fan housing, and an impeller which is connected to the motor. The impeller includes an impeller hub and a number of impeller blades which extend radially outwardly from the impeller hub. The shroud includes a cylindrical micro-perforated panel (Continued)

("MPP") liner which extends axially from proximate the inlet to proximate the impeller.

23 Claims, 7 Drawing Sheets

(58) Field of Classification Search
USPC ..... 415/119
See application file for complete search history.

(56) References Cited

U.S. PATENT DOCUMENTS

| | | | | |
|---|---|---|---|---|
| 7,540,354 | B2 | 6/2009 | Morin et al. | |
| 7,797,809 | B2 * | 9/2010 | Costa | B64D 33/02 29/458 |
| 9,856,745 | B2 * | 1/2018 | Ali | F02K 1/827 |
| 10,066,548 | B2 * | 9/2018 | Gilson | F02K 1/827 |
| 2002/0015640 | A1 | 2/2002 | Nishiyama et al. | |
| 2002/0036115 | A1 * | 3/2002 | Wilson | B32B 3/20 181/292 |
| 2004/0045766 | A1 * | 3/2004 | Porte | F02C 7/045 181/210 |
| 2006/0169533 | A1 * | 8/2006 | Patrick | B64D 33/02 181/210 |
| 2010/0189547 | A1 | 7/2010 | Shirahama et al. | |
| 2010/0242219 | A1 | 9/2010 | Dyson et al. | |
| 2011/0002775 | A1 | 1/2011 | Ma et al. | |
| 2011/0126544 | A1 * | 6/2011 | Foster | F02K 1/822 60/752 |
| 2011/0159797 | A1 | 6/2011 | Beltman et al. | |
| 2012/0085861 | A1 * | 4/2012 | Mardjono | F02C 7/24 244/1 N |
| 2013/0223973 | A1 * | 8/2013 | Ali | F02C 7/24 415/1 |
| 2014/0271132 | A1 | 9/2014 | Le Roy et al. | |

OTHER PUBLICATIONS

Cheng Yang et al., "Absorption of Oblique Incidence Sound by a Finite Micro-Perforated Panel Absorber," J. Acoust. Soc. Am., vol. 133, No. 1, Jan. 2013.

Dah-You Maa, "Potential of Microperforated Panel Absorber," J. Acoust. Soc. Am., vol. 104, No. 5, Nov. 1998.

L. S. Wirt, "Sound-Absorptive Materials to Meet Special Requirements," J. Acoust. Soc. Am., vol. 57, No. 1, Jan. 1975.

* cited by examiner

VANE-AXIAL FAN WITH A FAN HOUSING AND SHROUD HAVING AN INTEGRAL ACOUSTIC TREATMENT INCLUDING A MICRO-PERFORATED PANEL AND A PLURALITY OF COMPARTMENTS IN AN ANNULAR BACKSPACE FORMED BY A PLURALITY OF SHROUDS

BACKGROUND OF THE INVENTION

The present invention relates generally to vane-axial fans. In particular, the invention relates to a vane-axial fan which includes a number of sound reducing acoustic treatments that are integrated into the fan housing.

Fans are used in a myriad of applications. A problem that is common across many fan applications is the noise generated from aerodynamic interactions with the fan blades. Good design practices can be employed to minimize fan noise at the source; however, customer requirements often dictate even lower noise levels. For example, industrial, military and electronics cooling applications regulate fan noise to protect the hearing of machine operators, vehicle crew members and other people in the vicinity. Also, in certain applications strict requirements exist to reduce or eliminate the detectability of a vehicle, of which fan noise is a significant source.

Fan noise is primarily generated by aerodynamic interactions with the fan blades. The interaction sources may be components near the inlet, the guide vanes or the struts. The result is a broadband spectra with tone noise at the blade passing frequency and its multiples. These tones typically span a wide frequency range, often resulting in sound quality issues in frequencies at which the human ear is most sensitive.

Silencers can be effective when placed in ducting upstream or downstream of the fan; however, many applications are restricted by the allowable space. Furthermore, the silencer may increase the pressure rise required by the fan to deliver required performance in the application. Other applications employ micro perforated absorbers in an enclosure. For example, gas turbine engines have acoustic liners in the inlet and bypass fan ducts. These liners are designed and manufactured to target specific noise sources and frequency ranges. Due to the size and specificity of these liners, however, they are not directly scalable to fans typically used for air movement and cooling. The use of gas turbine type liners is impractical from a cost standpoint as well.

SUMMARY OF THE INVENTION

In accordance with the present invention, these and other limitations in the prior art are addressed by providing a fan which comprises a fan housing which includes a shroud having an upstream end that defines an inlet of the fan housing; a motor which is connected to the fan housing; and an impeller which is connected to the motor, the impeller including an impeller hub and a number of impeller blades which extend radially outwardly from the impeller hub; wherein the shroud includes a cylindrical micro-perforated panel ("MPP") liner which extends axially from proximate the inlet to proximate the impeller.

In accordance with an embodiment of the invention, the shroud comprises an inner shroud which includes the MPP liner and a tubular outer shroud which is positioned radially outwardly of the inner shroud to thereby define an annular backspace within the fan housing.

In this embodiment, the MPP liner may comprise a first diameter, the outer shroud may comprise a second diameter, and the ratio of the second diameter to the first diameter may be greater than or equal to about 1.6.

In accordance with another embodiment of the invention, the fan further comprises a number of axially extending struts which are positioned between the inner and outer shrouds to thereby divide the annular backspace into a plurality of axially extending compartments. In this embodiment, the struts may be spaced equally around the inner shroud. The fan of this embodiment may also comprise a number of walls which are positioned between the inner and outer shrouds and extend circumferentially between the struts. Further, the struts may be spaced equally around the inner shroud and the walls may be spaced equally from each other.

In accordance with yet another embodiment of the invention, the fan further comprises a number of radially extending walls which are positioned between the inner and outer shrouds to thereby divide the backspace into a plurality of cylindrical compartments. In this embodiment, the walls may be spaced equally from each other. The fan of this embodiment may further comprise a number of struts which are positioned between the inner and outer shrouds and extend axially between the walls. Also, the walls may be spaced equally from each other and the struts may be spaced equally around the inner shroud.

In accordance with another embodiment of the invention, the outer shroud may converge between an upstream end of the outer shroud and a downstream end of the outer shroud. Alternatively, the outer shroud may diverge between an upstream end of the outer shroud and a downstream end of the outer shroud.

The present invention is also directed to a vane-axial fan which comprises a fan housing which includes a shroud having an upstream end that defines an inlet of the fan housing, the shroud comprising a cylindrical inner shroud and a tubular outer shroud which is positioned radially outwardly of the inner shroud to thereby define an annular backspace between the inner and outer shrouds; a motor which is connected to the fan housing; and an impeller which is connected to the motor, the impeller including an impeller hub and a number of impeller blades which extend radially outwardly from the impeller hub; wherein at least a portion of the inner shroud is comprised of a cylindrical micro-perforated panel ("MPP") liner which together with the outer shroud defines at least a portion of the backspace.

In accordance with one aspect of this embodiment, the MPP liner may comprise a first diameter, the outer shroud may comprise a second diameter, and the ratio of the second diameter to the first diameter may be greater than or equal to about 1.6.

In accordance with a further aspect of this embodiment, the fan further comprises a number of axially extending struts which are positioned between the inner and outer shrouds to thereby divide the annular backspace into a plurality of axially extending compartments. In this embodiment, the struts may be spaced equally around the inner shroud. The fan of this embodiment may also comprise a number of walls which are positioned between the inner and outer shrouds and extend circumferentially between the struts. Further, the struts may be spaced equally around the inner shroud and the walls may be spaced equally from each other.

In accordance with another aspect of this embodiment, the fan further comprises a number of radially extending walls which are positioned between the inner and outer shrouds to thereby divide the backspace into a plurality of cylindrical compartments. In this embodiment, the walls may be spaced equally from each other. The fan of this embodiment may further comprise a number of struts which are positioned between the inner and outer shrouds and extend axially between the walls. Also, the walls may be spaced equally from each other and the struts may be spaced equally around the inner shroud.

In accordance with yet another aspect of this embodiment, the outer shroud may converge between an upstream end of the outer shroud and a downstream end of the outer shroud. Alternatively, the outer shroud may diverge between an upstream end of the outer shroud and a downstream end of the outer shroud.

Thus, the present invention provides an acoustic treatment which is incorporated into a fan housing for the purpose of noise reduction. The treatment is composed of a micro-perforated panel (MPP) and possibly also a backspace. The integration of the acoustic treatment into the fan housing makes this design unique compared to existing fan noise silencing and treatment systems which are external to the fan itself.

Unique advantages exist in using an MPP liner with a backspace in the housing of a small fan. The backspace is in the shape of an annulus, and when compartmentalized the cavities are trapezoidal in shape. The irregular shape enhances the frequency and absorption characteristics relative to a constant backspace. An advantage of using an MPP liner integrated into a fan housing of smaller diameter is the ability to design a unique backspace cavity shape in the available space.

These and other objects and advantages of the present invention will be made apparent from the following detailed description with reference to the accompanying drawings. In the drawings, the same reference numbers are used to denote similar components in the various embodiments.

DETAILED DESCRIPTION OF THE INVENTION

The present invention is applicable to a variety of air movers. For purposes of brevity, however, it will be described in the context of an exemplary vane-axial cooling fan. Nevertheless, a person of ordinary skill in the art will readily appreciate how the teachings of the present invention can be applied to other types of air movers. Therefore, the following description should not be construed to limit the scope of the present invention in any respect.

Figure 1:
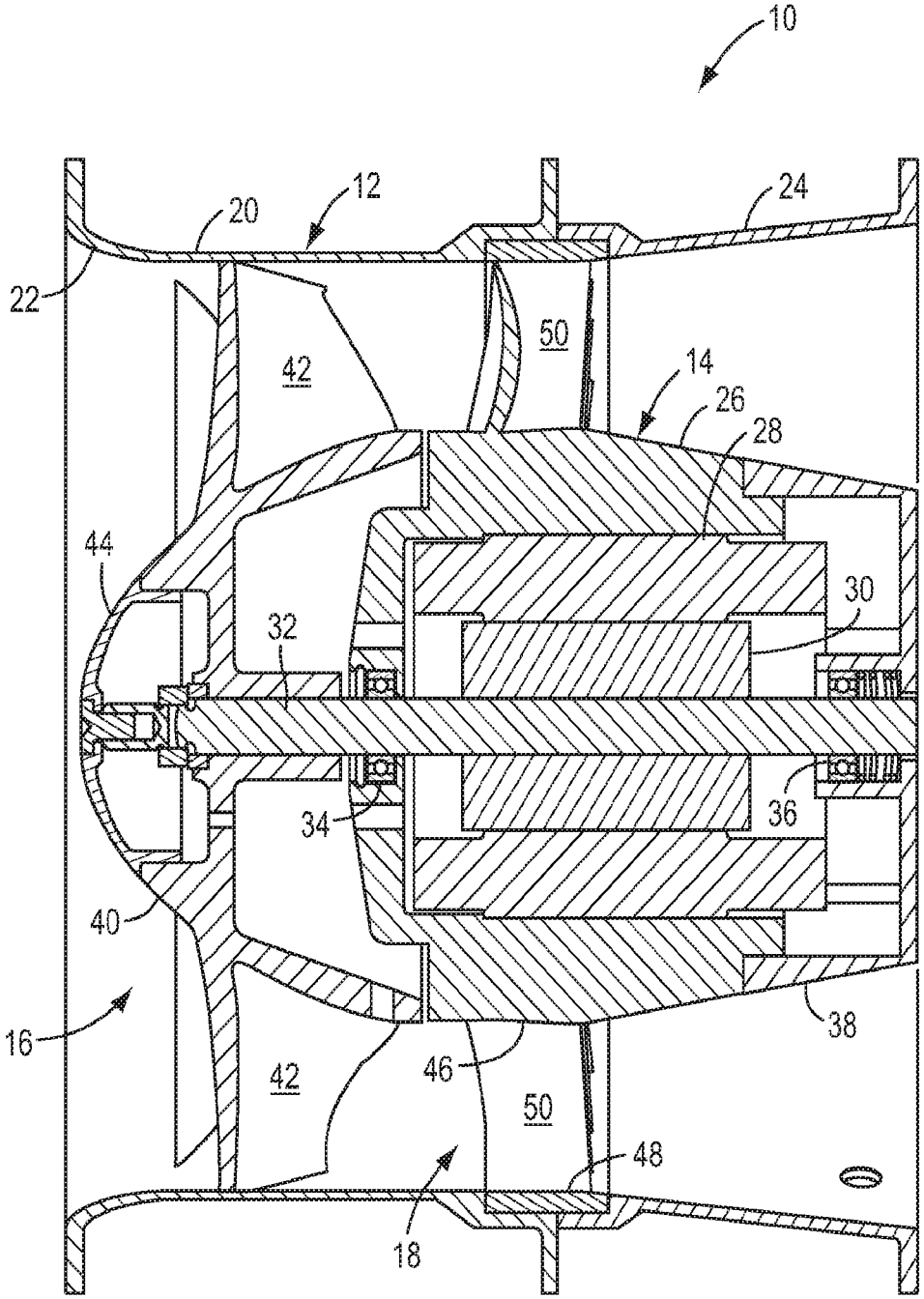
FIG. 1 (Prior Art)
FIG. 1 is a cross-sectional view of an example of a prior art vane axial cooling fan.

To provide context for the present invention, an exemplary prior art vane-axial cooling fan will first be described with reference to FIG. 1. The prior art cooling fan, which is indicated generally by reference number 10, is shown to comprise a tubular fan housing 12, a motor 14 which is supported in the fan housing 12, an impeller 16 which is driven by the motor 14, and an outlet guide vane assembly 18 which extends radially between the motor 14 and the fan housing 12. The fan housing 12 includes a shroud 20 which surrounds the impeller 16, an inlet opening 22 which is formed at the upstream edge of the shroud, and a diffuser section 24 which is connected to the downstream edge of the shroud proximate the outlet guide vane assembly 18.

The motor 14 includes a motor housing 26, a stator 28 which is mounted in the motor housing, a rotor 30 which is positioned within the stator and a rotor shaft 32 which is connected to the rotor. The rotor shaft 32 is rotatably supported in a front bearing 34 which is mounted in an upstream end of the motor housing 26 and a rear bearing 36 which is mounted in a tail cone 38 that in turn is mounted to the downstream end of the motor housing. The impeller 16 includes an impeller hub 40 and a number of impeller blades 42 which extend radially outwardly from the impeller hub. The impeller hub 40 may also include a removable nose cone 44 to facilitate mounting the impeller 16 to the rotor shaft 32. The outlet guide vane assembly 18 includes an inner ring 46 which is attached to or formed integrally with the motor housing 28, an outer ring 48 which is connected to or formed integrally with the fan housing 12 and a plurality of guide vanes 50 which extend radially between the inner and outer rings. Thus, in addition to its normal function of straightening the air stream generated by the impeller 16, the outlet guide vane assembly 18 serves to connect the motor 14 to the fan housing 12.

As discussed above, aerodynamic interactions between the impeller blades and other components of the fan can generate unwanted noise. In accordance with the present invention, acoustic treatments are integrated into the fan in order to reduce the unwanted noise to acceptable levels. These acoustic treatments may be incorporated into such components as the fan housing or the impeller hub.

Figure 2:
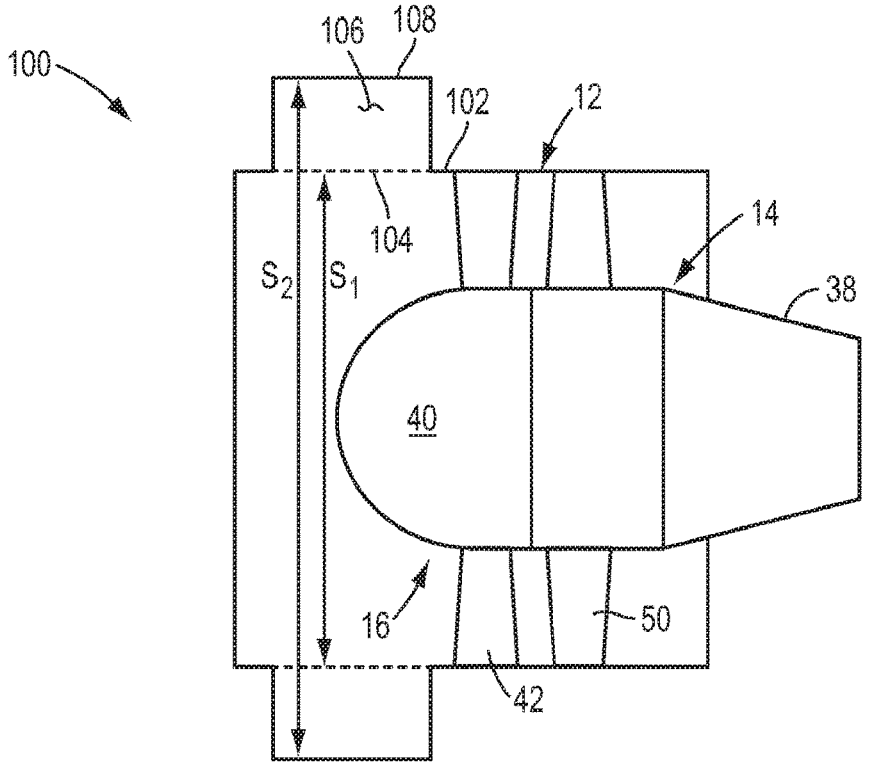
FIG. 2 is a cross sectional representation of one embodiment of the cooling fan of the present invention.
Figure 3:
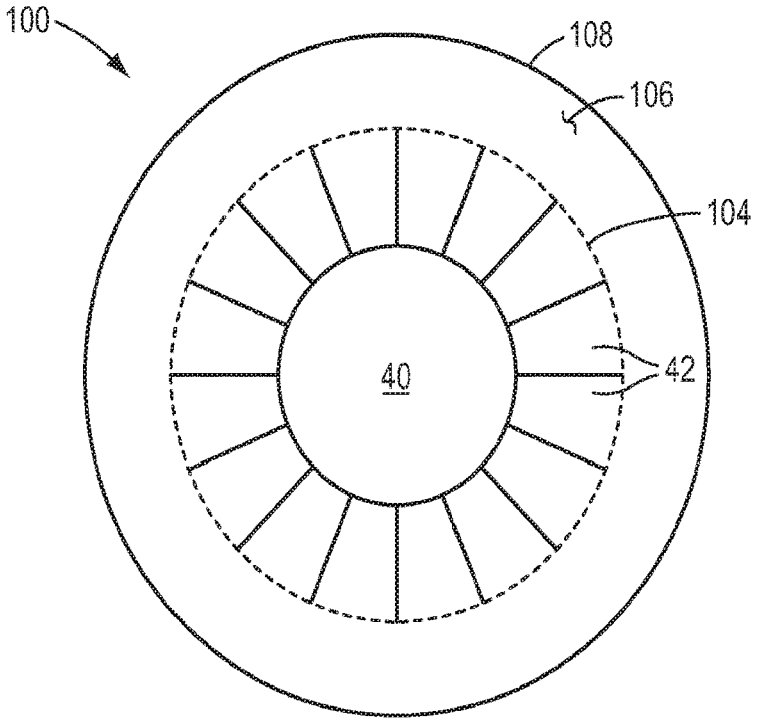
FIG. 3 is a front elevation representation of the cooling fan depicted in FIG. 2.

Referring to FIGS. 2 and 3, for example, a first embodiment of the present invention is shown schematically to include sound absorbing acoustic treatments which are incorporated into the fan housing. The fan of this embodiment, generally 100, includes an inner shroud 102 having a cylindrical liner 104 which is constructed from a sound absorbing micro-perforated panel ("MPP"). In order to increase the sound absorbing effect of the MPP liner 104, the shroud 102 may also include an annular backspace 106 which is formed by securing a cylindrical outer shroud 108 to the fan housing 12 over the MPP liner 104. In this embodiment, optimal sound absorption is achieved when two geometric characteristics are met; 1) the acoustic impedance of the MPP is matched to the impedance of the sound waves; and 2) the geometry of the backspace is tuned to reduce noise in the intended frequency range.

For a particular fan application, the desired acoustic impedance of the MPP can be estimated based on the fan acoustic modes which are to be attenuated and the mode propagation angle. The acoustic impedance of an MPP is dependent on the geometry, i.e., the hole or slit dimensions, percent open area, and sheet thickness of the MPP. This value can be estimated for an MPP with circular holes, but needs to be measured for more complicated geometry. In some cases, the impedance values can be obtained from the MPP supplier. The MPP can be made from any number of materials, such as aluminum alloy, and the perforations can be circular holes or slits. The MPP can either be purchased commercially or designed specifically for an intended application. The specific MPP selected for a particular application may be based on the acoustic impedance, manufacturability, cost and availability of the material. Depending on the size and acoustic characteristics of the fan in which the MPP will be employed, commercially available MPP products may be suitable.

The geometry of the backspace 106 is designed with three factors in mind:

frequency range where noise attenuation is needed;

fan geometry; and available space.

The frequency range of noise attenuation is dependent on the geometry of the backspace 106. This frequency range can be easily calculated for a simple constant air gap. However, when the geometry of the backspace is irregularly shaped, the frequency range of noise attenuation is more challenging to estimate. In these circumstances, the frequency range can be determined experimentally or by using boundary element method analysis.

When the MPP liner 104 is integrated into the inner shroud 102, the fan geometry and available space may lend themselves to design practices for the backspace 106 which are similar to a muffler found on an internal combustion engine. For a small fan, it may be practical to design the backspace 106 to achieve a sufficient expansion ratio for the desired noise reduction. For example, up to 1 dB of noise reduction is possible for an expansion ratio of 1.6 or greater, which is defined as the diameter $S_2$ of the outer shroud 108 divided by the diameter $S_1$ of the MPP liner 104.

In accordance with the present invention, further improvements in noise attenuation may be achieved by compartmentalizing the backspace 106. Without compartments, the MPP liner 104 is most effective for a sound wave front that is normal to the MPP liner. In the fan 100, however, the acoustic waves are multi-directional, with some acoustic modes travelling at an angle or nearly parallel to the MPP liner 104. Compartmentalizing the backspace enhances the acoustic absorption in a multidirectional sound field by forcing the local acoustic velocity to be normal to the MPP liner 104. The compartments are effective in this way when the dimensions are small compared to the wavelength of the frequencies of interest.

Figure 4:
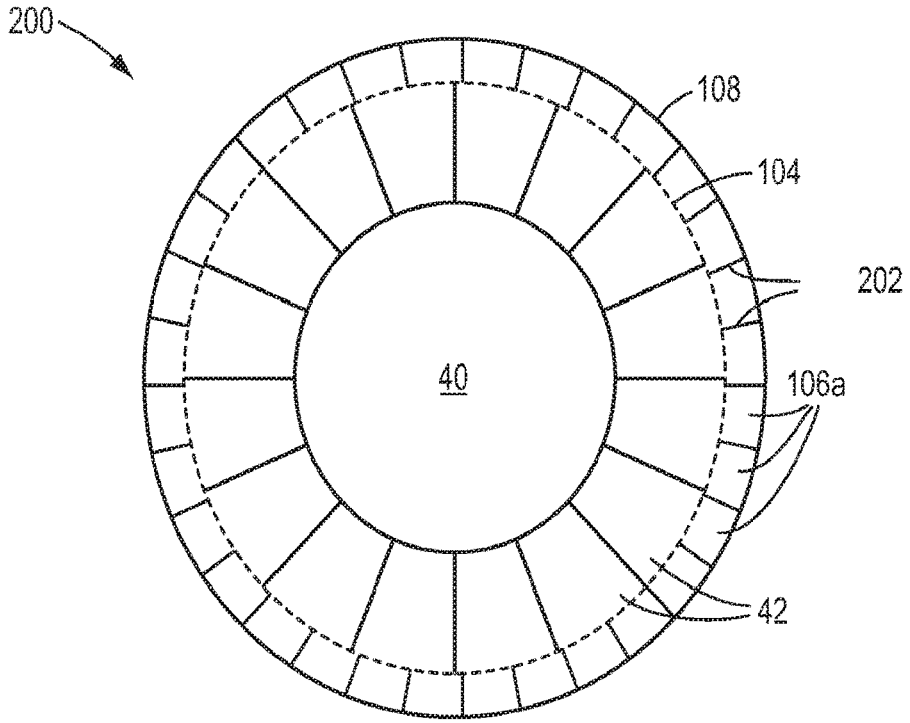
FIG. 4 is a front elevation representation of a second embodiment of the cooling fan of the present invention.

Referring to FIG. 4, for example, a second fan embodiment 200 is shown in which the backspace is divided into a plurality of axially extending compartments 106*a* by positioning a plurality of equally spaced, axially extending struts 202 between the MPP liner 104 and the outer shroud 108. When the annular backspace is divided in this manner, the compartments 106*a* will assume a generally trapezoidal shape.

Figure 5:
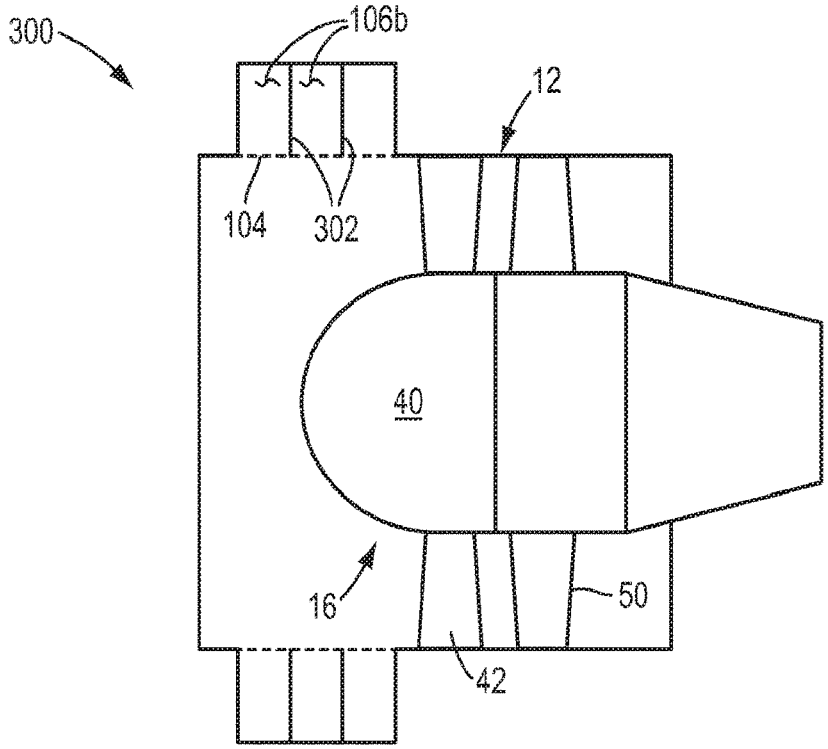
FIG. 5 is a cross sectional representation of a third embodiment of the cooling fan of the present invention.

Referring to FIG. 5, a third fan embodiment 300 is shown in which the backspace is divided into successive cylindrical compartments 106*b* by positioning a series of equally spaced, circumferentially extending walls 302 between the MPP liner 104 and the outer shroud 108. These multiple rows of compartments 106*b* may be used if space allows, since the increased treatment surface area will improve noise attenuation.

As an alternative to the fan embodiments shown in FIGS. 4 and 5, the backspace can be divided in to multiple compartments having differing geometries in order to target a number of frequency ranges for noise attenuation.

Figure 6:
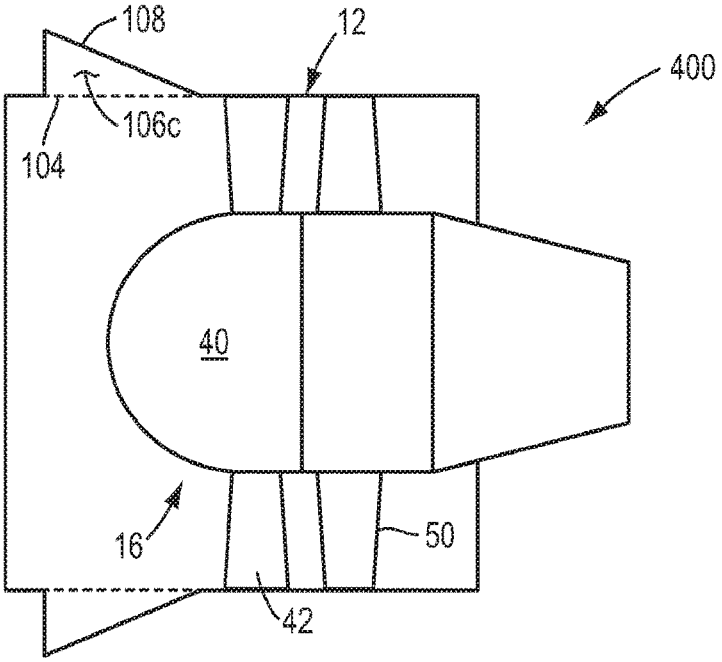
FIG. 6 is a cross sectional representation of a fourth embodiment of the cooling fan of the present invention.

Referring to FIG. 6, a fourth fan embodiment 400 is shown in which the outer shroud 108 converges between its upstream and downstream ends to thereby create a backspace 106*c* having a conical shape. In this regard, it should be noted that conical mufflers are especially effective at reducing tone noise. When tuned to the correct frequency, tones at all harmonic multiples are attenuated with a conical muffler. The high frequencies of interest, thus small wavelengths, in a small high-speed fan make this possible in a smaller space than required for an internal combustion engine muffler. Of course, the shroud 108 could be designed to diverge instead of converge.

An illustrative embodiment of the invention incorporating the acoustic treatments described above is shown in FIGS. 7 and 8. The fan of this embodiment, generally 500, includes a fan housing 12 which is comprised of an inner shroud 502 and an outer shroud 504. The inner shroud 502 includes a cylindrical MPP liner 506 which extends axially from proximate the inlet opening 22 to proximate the upstream edge of the impeller blades 42. The outer shroud 504 is spaced radially from the inner shroud 502 to thereby define a cylindrical backspace 508 within the fan housing 12. The backspace 508 may extend axially from the upstream end of the housing 12 to proximate the outlet guide vane assembly 18. Also, the backspace 508 may be divided into multiple compartments 508*a* by a plurality of axially extending struts 510 and/or circumferentially extending walls 512.

Figure 7:
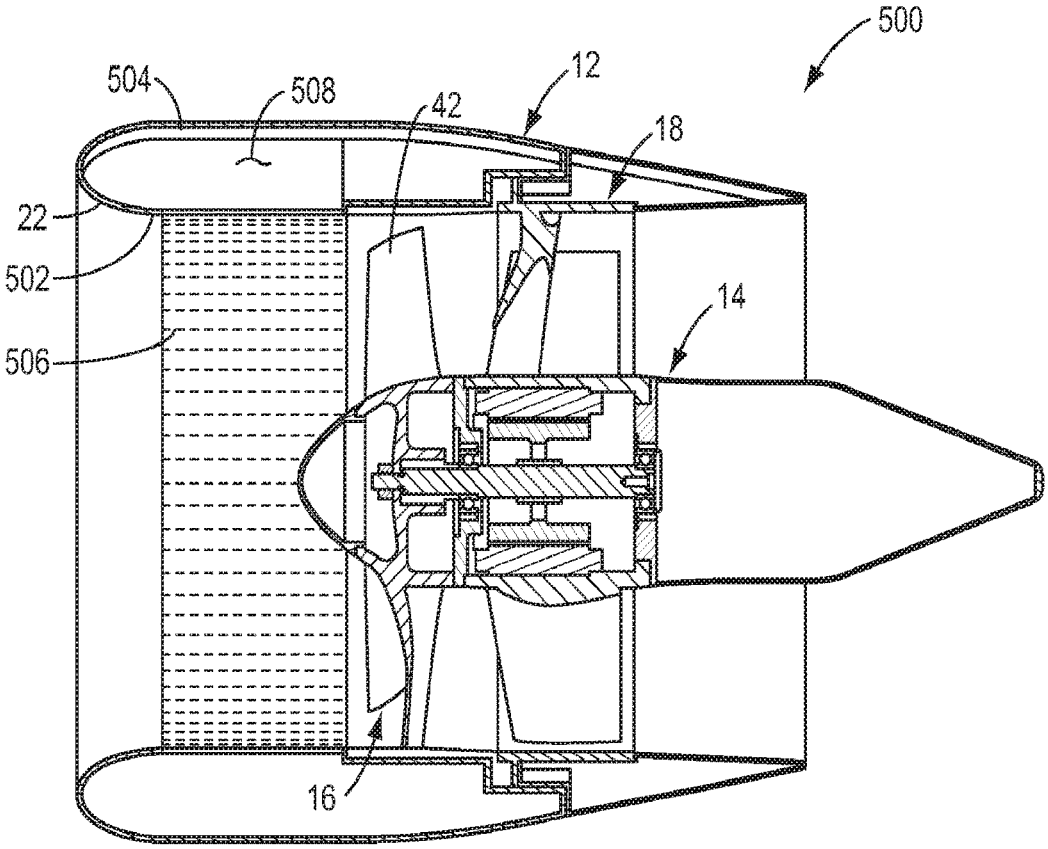
FIG. 7 is a cross sectional view of a fifth embodiment of the cooling fan of the present invention.
Figure 8:
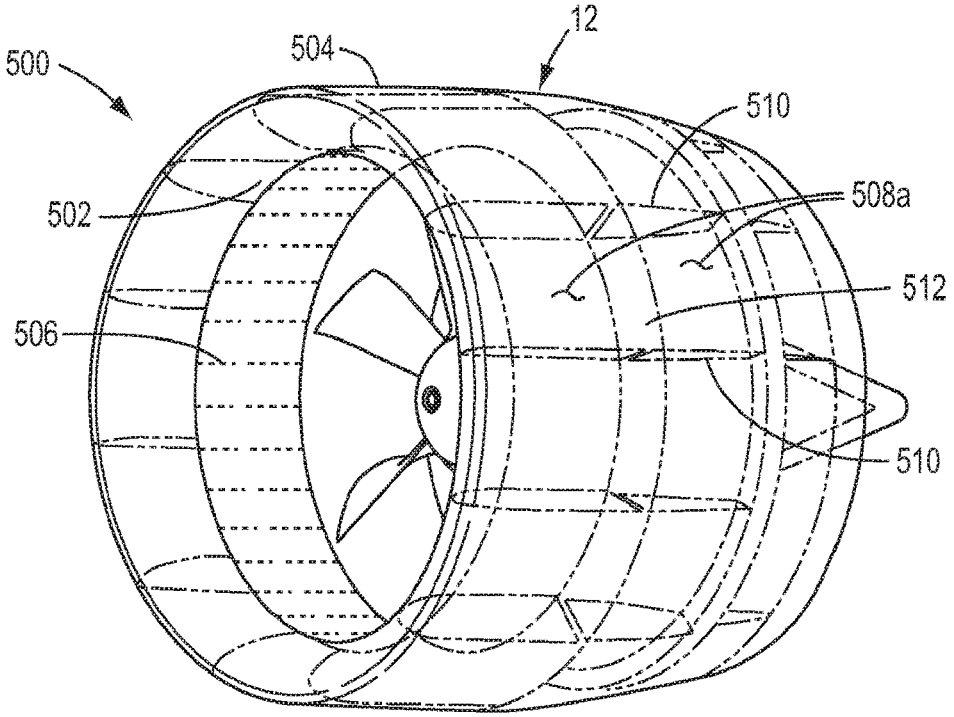
FIG. 8 is a front perspective view of the cooling fan shown in FIG. 7.
Figure 9:
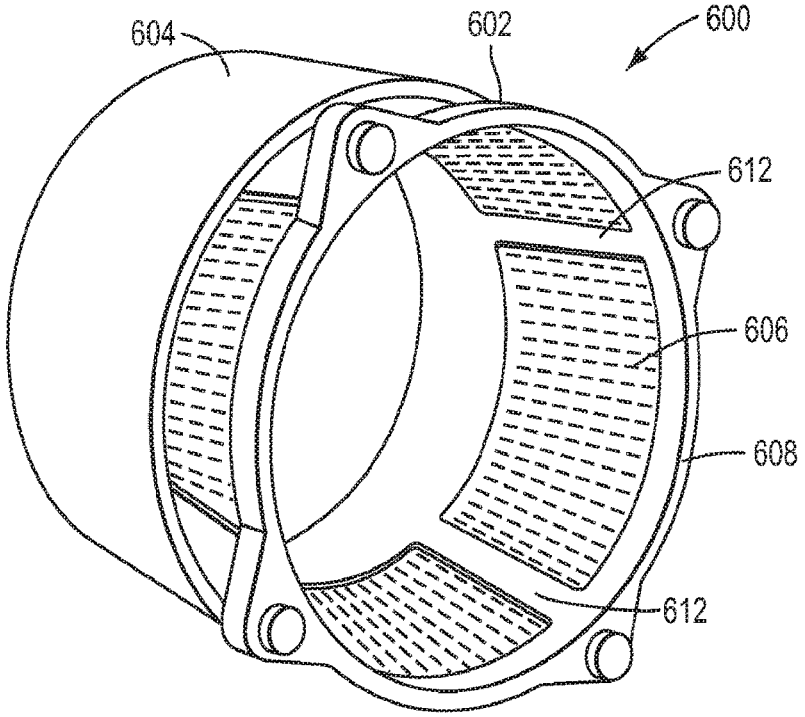
FIG. 9 is an exploded perspective view of an embodiment of a shroud component of a fan housing comprising a conical backspace in accordance with the present invention.
Figure 10A:
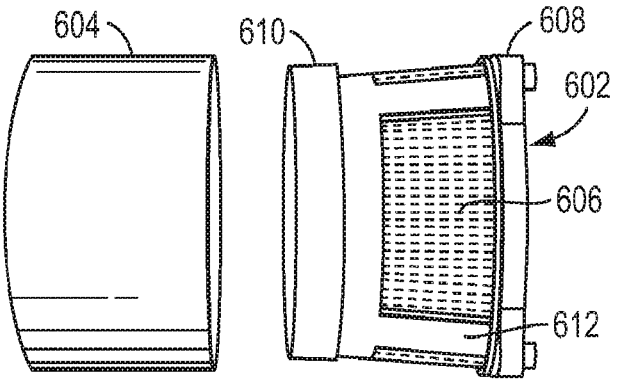
FIGS. 10A-10D are side elevation views illustrating the steps of assembling the fan shroud shown in FIG. 9.
Figure 10B:
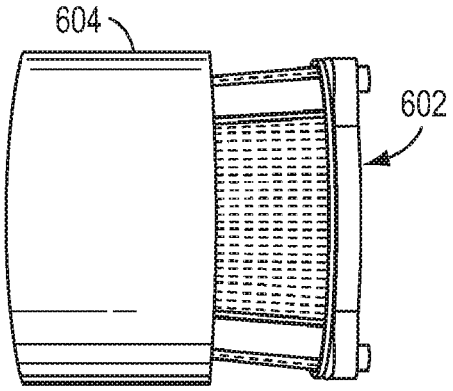
Figure 10C:
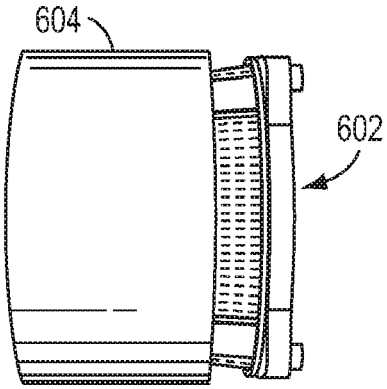
Figure 10D:
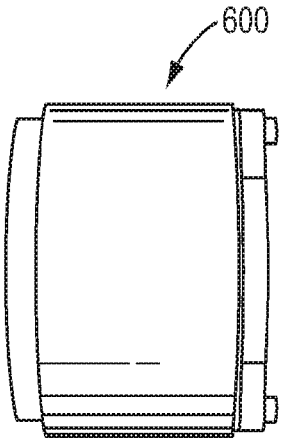
Figure 11:
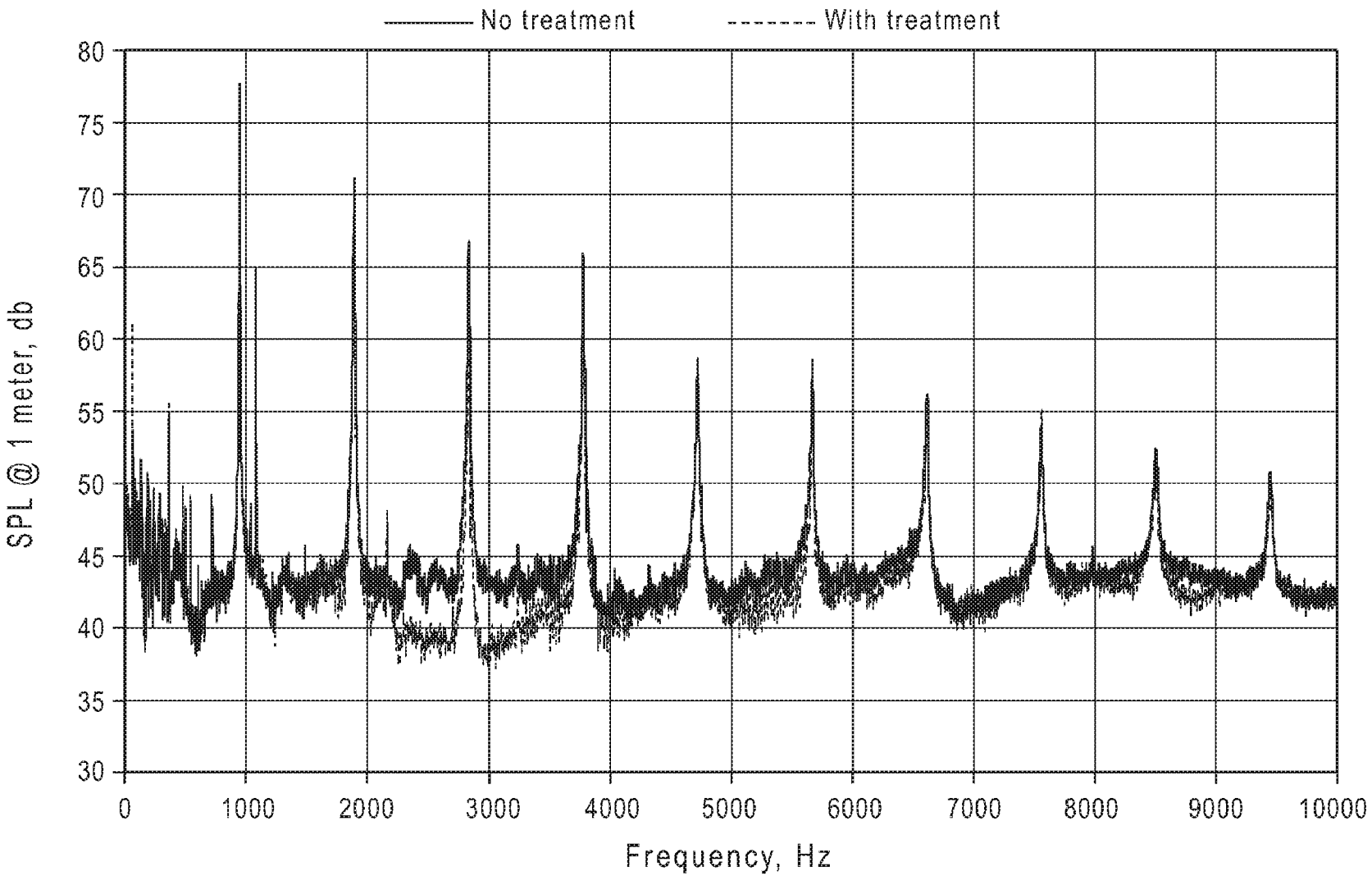
FIG. 11 is a graph showing the results of the noise reduction achieved by the fan of FIG. 7.

In the specific embodiment of the fan 500 shown in FIGS. 7 and 8, the diameter of the inner shroud 502 is 8.2 inches, the diameter of the outer shroud 504 is 10.0 inches, and the height of the radial backspace 508 is accordingly 0.9 inch. In addition, the backspace 508 is compartmentalized by spaces 508*a* measuring 2.65 inches by 2.65 inches at the face of the MPP liner 506. The downstream end of the MPP liner 506 is spaced 0.4 inches from the upstream edge of the impeller blades 42, and the axial length of the MPP liner is 5.8 inches. Also, the MPP liner 506 extends around the entire circumference of the inner shroud 502 and therefore comprises a total surface area of 150 inches squared. The backspace geometry was chosen to target noise reduction in a specific frequency range in order to meet maximum noise requirements for a particular fan application. As shown in FIG. 11, the results are significant. Noise reduction of up to 6 dB was achieved at certain frequencies. The largest impact was seen in broadband noise between 2 kHz and 4 kHz.

Referring now to FIGS. 9 and 10A-10D, an embodiment of a fan shroud is shown which includes some of the acoustic treatments described above. The fan shroud, generally 600, comprises a conical inner shroud 602 and a cylindrical outer shroud 604. The inner shroud comprises an MPP liner 606 which is positioned between an upstream ring 608 and a downstream ring 610 and is held in position by a number of stringers 612 connected between the upstream and downstream rings. In order to assemble the shroud 600, the inner shroud 602 is inserted into the outer shroud 604 until the upstream and downstream rings 608, 610 are sealed against the respective upstream and downstream ends of the outer shroud. The sequence of such assembly is shown in FIGS. 10A-10D. Since the inner shroud 602 is conical and the outer shroud 604 is cylindrical, the backspace defined between the inner and outer shrouds is conical. The shroud 600 may be used in conjunction with a conventional fan to provide the sound reducing advantages of the MPP liner 606 and the conical backspace.

It should be recognized that, while the present invention has been described in relation to the preferred embodiments thereof, those skilled in the art may develop a wide variation of structural and operational details without departing from the principles of the invention. For example various features of the different embodiments may be combined in a manner not described herein. Therefore, the appended claims are to be construed to cover all equivalents failing within the true scope and spirit of the invention.

What is claimed is:

1. A vane-axial fan which comprises:

a fan housing which includes a shroud having an upstream end that defines an inlet opening of the fan housing;

a motor which is connected to the fan housing; and an impeller which is connected to the motor, the impeller including an impeller hub and a number of impeller blades which extend radially outwardly from the impeller hub;

wherein the shroud includes a cylindrical micro-perforated panel ("MPP") liner which extends axially from proximate the inlet opening to proximate an upstream edge of the impeller blades; and a plurality of straight, axially extending struts which are positioned between the inner and outer shrouds, wherein the struts extend in a radial direction completely between the inner and outer shrouds and in an axial direction completely between an upstream end and a downstream end of the annular backspace to thereby divide the annular backspace into a plurality of compartments which extend completely between the inner and outer shrouds.

2. The fan of claim 1, wherein the shroud comprises an inner shroud which includes the MPP liner and a tubular outer shroud which is positioned radially outwardly of the inner shroud to thereby define an annular backspace within the fan housing which is bounded radially by the inner and outer shrouds.

3. The fan of claim 2, wherein the MPP liner comprises a first diameter, the outer shroud comprises a second diameter, and the ratio of the second diameter to the first diameter is greater than or equal to about 1.6.

4. The fan of claim 2, wherein the struts are spaced equally around the inner shroud.

5. The fan of claim 1, further comprising a number of straight walls which are positioned and extend completely between the inner and outer shrouds and extend circumferentially between the struts.

6. The fan of claim 5, wherein the struts are spaced equally around the inner shroud and the walls are spaced equally from each other.

7. The fan of claim 2, further comprising a number of radially extending walls which are positioned between the inner and outer shrouds to thereby divide the backspace into a plurality of cylindrical compartments.

8. The fan of claim 5, wherein the walls are spaced equally from each other.

9. The fan of claim 7, further comprising a number of struts which are positioned between the inner and outer shrouds and extend axially between the walls.

10. The fan of claim 9, wherein the walls are spaced equally from each other and the struts are spaced equally around the inner shroud.

11. The fan of claim 2, wherein the outer shroud converges between an upstream end of the outer shroud and a downstream end of the outer shroud.

12. The fan of claim 2, wherein the outer shroud diverges between an upstream end of the outer shroud and a downstream end of the outer shroud.

13. A vane-axial fan which comprises:

a fan housing which includes a shroud having an upstream end that defines an inlet opening of the fan housing, the shroud comprising a cylindrical inner shroud and a tubular outer shroud which is positioned radially outwardly of the inner shroud to thereby define an annular backspace between the inner and outer shrouds which is bounded by the inner and outer shrouds;

a motor which is connected to the fan housing; and an impeller which is connected to the motor, the impeller including an impeller hub and a number of impeller blades which extend radially outwardly from the impeller hub;

wherein at least a portion of the inner shroud is comprised of a cylindrical micro-perforated panel ("MPP") liner which together with the outer shroud defines at least a portion of the backspace; and a plurality of straight, axially extending struts which are positioned between the inner and outer shrouds, wherein the struts extend in a radial direction completely between the inner and outer shrouds and in an axial direction completely between an upstream end and a downstream end of the annular backspace to thereby divide the annular backspace into a plurality of compartments which extend completely between the inner and outer shrouds.

14. The fan of claim 13, wherein the MPP liner comprises a first diameter, the outer shroud comprises a second diameter, and the ratio of the second diameter to the first diameter is greater than or equal to about 1.6.

15. The fan of claim 13, wherein the struts are spaced equally around the inner shroud.

16. The fan of claim 13, further comprising a number of straight walls which are positioned and extend completely between the inner and outer shrouds and extend circumferentially between the struts.

17. The fan of claim 16, wherein the struts are spaced equally around the inner shroud and the walls are spaced equally from each other.

18. The fan of claim 13, further comprising a number of straight, radially extending walls which are positioned and extend completely between the inner and outer shrouds to thereby divide the backspace into a plurality of cylindrical compartments which extend completely between the inner and outer shrouds.

19. The fan of claim 18, wherein the walls are spaced equally from each other.

20. The fan of claim 18, further comprising a number of straight struts which are positioned and extend completely between the inner and outer shrouds and extend axially between the walls.

21. The fan of claim 20, wherein the walls are spaced equally from each other and the struts are spaced equally around the inner shroud.

22. The fan of claim 13, wherein the outer shroud converges between an upstream end of the outer shroud and a downstream end of the outer shroud.

23. The fan of claim 13, wherein the outer shroud diverges between an upstream end of the outer shroud and a downstream end of the outer shroud.

* * * * *